United States Patent [19]

Smith-Johannsen et al.

[11] Patent Number: 4,954,695

[45] Date of Patent: Sep. 4, 1990

[54] SELF-LIMITING CONDUCTIVE EXTRUDATES AND METHODS THEREFOR

[75] Inventors: Robert Smith-Johannsen; Jack M. Walker, both of Portola Valley, Calif.

[73] Assignee: Raychem Corporation, Menlo Park, Calif.

[21] Appl. No.: 195,558

[22] Filed: May 12, 1988

Related U.S. Application Data

[60] Continuation of Ser. No. 475,885, Mar. 16, 1983, abandoned, which is a continuation of Ser. No. 175,356, Aug. 4, 1980, abandoned, which is a division of Ser. No. 868,517, Jan. 11, 1978, Pat. No. 4,286,376, which is a continuation of Ser. No. 542,592, Jan. 20, 1975, abandoned, which is a continuation of Ser. No. 287,444, Sep. 8, 1972, Pat. No. 3,861,029.

[51] Int. Cl.[5] ..... H05B 3/10

[52] U.S. Cl. ..... 219/548; 219/544; 338/22 SD; 29/611

[58] Field of Search ..... 219/548, 544, 301; 264/104, 105; 338/22 SD, 22 R, 214; 29/611

[56] References Cited

U.S. PATENT DOCUMENTS

| | | | |
|---|---|---|---|
| 2,282,832 | 5/1941 | Spooner | 201/76 |
| 2,905,919 | 1/1957 | Lorch et al. | 338/224 |
| 3,155,631 | 11/1964 | Zapp | 260/28.5 |
| 3,243,753 | 3/1966 | Kohler | 338/31 |
| 3,277,419 | 10/1966 | Butz | 338/314 |
| 3,308,528 | 3/1967 | Bullard et al. | 29/155.7 |
| 3,344,385 | 9/1967 | Bartos et al. | 338/212 |
| 3,410,984 | 11/1968 | Sandford et al. | 219/212 |
| 3,412,358 | 11/1968 | Hummel | 338/7 |
| 3,435,401 | 3/1969 | Epstein | 338/214 |
| 3,591,526 | 7/1971 | Kawashima | 252/511 |
| 3,629,154 | 12/1971 | Johnson | 252/511 |
| 3,654,187 | 4/1972 | Takenaka | 252/511 |
| 3,760,495 | 9/1973 | Meyer | 29/610 |
| 3,793,716 | 2/1974 | Smith-Johannsen | 29/611 |
| 3,823,217 | 7/1974 | Kampe | 264/105 |
| 3,861,029 | 1/1975 | Smith-Johannsen | 29/611 |
| 3,862,056 | 1/1975 | Hartman | 252/511 |
| 3,914,363 | 10/1975 | Bedard et al. | 264/105 |
| 4,286,376 | 9/1981 | Smith-Johannsen et al. | 29/611 |

FOREIGN PATENT DOCUMENTS

| | | |
|---|---|---|
| 1305140 | 12/1962 | France . |
| 41-8537 | 4/1966 | Japan . |
| 828233 | 2/1960 | United Kingdom . |
| 828334 | 2/1960 | United Kingdom . |
| 1053331 | 12/1966 | United Kingdom . |
| 1201166 | 8/1970 | United Kingdom . |

OTHER PUBLICATIONS

Birks, Modern Dielectric Materials, p. 105.

J. Meyer, Polymer Engineering and Science 13, 462–467 (Nov. 1973).

Ohe, Japan Journal Applied Physics 10, No. 1, pp. 99–108 (Jan. 1971), (in English).

Kirk Othmer, Encyclopedia of Polymer Science and Technology, 2, pp. 726 and 6, 300.

Ohkita, Rubber Digest, Jan. 1983, 124–129 (translation attached).

Shobo, Study and Application of Conductive Polymers, Yokokawa Shoto, Aug. 18, 1970, pp. 207 and 234–236 (translation attached).

Hobun, Report 44, No. 1 (1971), p. 85 (translation attached).

*Primary Examiner*—Bruce A. Reynolds
*Assistant Examiner*—Marvin M. Lateef
*Attorney, Agent, or Firm*—Timothy H. P. Richardson; Herbert G. Burkard

[57] ABSTRACT

Self-regulating articles, particularly heaters, containing two spaced-apart elongate electrodes which are joined together by a melt-extruded element composed of a conductive polymer. The conductive polymer is a dispersion of carbon black in a crystalline polymer, has a resistivity at room temperature of R ohm-cm, and contains L % by weight of carbon black, L being not greater than about 15, and L and R being such that $$2L+5\log_{10}R \leqq 45.$$

18 Claims, 1 Drawing Sheet

SELF-LIMITING CONDUCTIVE EXTRUDATES AND METHODS THEREFOR

This application is a continuation of copending Ser. No. 475,885 filed Mar. 16, 1983, now abandoned, which is a continuation of Ser. No. 175,356 filed Aug. 4, 1980 (now abandoned), which is a divisional of Ser. No. 868,517 filed Jan. 11, 1978 (now U.S. Pat. No. 4,286,376), which is a continuation of Ser. No. 542,592, filed Jan. 20, 1975 (now abandoned), which is a continuation of Ser. No. 287,444 filed Sept. 8, 1972 (now U.S. Pat. No. 3,861,029). The disclosure of each of the above-mentioned applications is incorporated herein by reference.

BACKGROUND OF THE INVENTION

Electrically conductive thermoplastic compositions have previously been achieved by the addition of conductive carbon black to a polymeric base. In one category of such compositions, advantage has been taken of a non-linear positive temperature resistivity coefficient displayed by the particular material to obtain self-regulating or current-limiting semi-conductive articles. In U.S. Pat. No. 3,243,753 to Kohler, one such composition is described as containing from 25% to 75% carbon black about which the polymeric matrix has been formed by in situ polymerization. As the temperature of such a composition increases, either through a rise in ambient temperature or by reason of resistive heating occasioned by the passage of current therethrough, the polymer matrix expands at a rate greater than that of the carbon black particles which, in an interconnected array of channels, impart the property of conductivity. The resulting diminution in the number of current-carrying channels decreases the amount of power generated by $I^2R$ heating. This self-limiting feature may be put to work in, e.g. heat tracing pipes in chemical plants for freeze protection, maintaining flow characteristics of viscous syrups, etc. In such applications, articles formed from the conductive composition ideally attain and maintain a temperature at which energy lost through heat transfer to the surroundings equal that gained from the current. If the ambient temperature then falls, increased heat transfer to the surroundings is met by increased power generation owing to the resistivity decrease associated with the article's lowered temperature. In short order, parity of heat transfer and power generation is again attained. Conversely, where ambient temperature increases heat transfer from the conductive article is reduced and the resistivity rise resulting from increased temperature diminishes or stops $I^2R$ heating.

Self-regulating conductive compositions may, of course, be used in employments other than positive heating, for example, in heat sensing and circuit-breaking applications. In every case, however, the high carbon black content characteristic of most prior art compositions is disadvantageous. High black loadings are associated with inferior elongation and stress crack resistance, as well as low temperature brittleness. In addition, high black loading appears to adversely affect the current-regulating properties of the conductive compositions. If a semi-conductive thermoplastic composition is externally heated and its resistivity plotted against temperature (on the abscissa) the resulting curve will show resistivity rising with temperature from the low room temperature value (Ri) to a point of "peak resistance" (Rp), following which additional increase in temperature occasions a precipitous resistivity drop associated with the melt phase of the polymer matrix. To avoid resistance runaway with the concomitant irreversible change in resistivity characteristics, the practice of cross-linking the polymer matrix has grown up, in which event resistivity levels off at the peak temperature and remains constant upon further increase in ambient temperature. Cross-linked semi-conductive articles with high black loadings exhibit undesirably low resistivity when brought to peak temperature by exposure to very high or low ambient temperatures. In such instances poor heat transfer characteristics can prevent dissipation of $I^2Rp$ generation, causing burnout.

It would accordingly be desirable to prepare semi-conductive self-regulating articles with substantially lower black contents, with the objects, inter alia, of improving flexural and other physical properties and substantially increasing the ratio Rp/Ri. However, attainment of these goals has in large part been precluded by the extremely high room temperature resistivities exhibited by polymers with low black loadings. In Cabot Corporation's Pigment Black Technical Report S-8, entitled "Carbon Blacks for Conductive Plastics" percent carbon-resistivity curves for various polymers containing "Vulcan XC-72", an oil furnace black, show resistivities of 100,000 ohm-cm or more, asymptotically increasing at black loadings of about 15%. Others have reported similarly high resistivities with low black loads. Recently resistivities sufficiently low for freeze protection applications have been achieved with low black loadings by resort to the special deposition techniques, such as solvent coating, disclosed in commonly assigned copending U.S. patent application Ser. No. 88,841, filed Nov. 12, 1970 by Robert Smith-Johannsen (now abandoned). Self-limiting compositions have been extruded heretofore, e.g., U.S. Pat. No. 3,435,401 to Epstein, but when low black loading has been attempted the extrudates have exhibited room temperature resistivities of $10^7$ ohm-cm or higher, essentially those of the polymer matrices themselves. Indeed, the patentees of G.B. Pat. No. 1,201,166 urge the avoidance of hot melt techniques where significant conductivities are desired with less than about 20% black.

SUMMARY OF THE INVENTION

We have now for the first time obtained self-limiting extrudates advantaged by low black loading yet exhibiting room temperature (hereafter, 70° F.) resistivities in the useful range from about 5 to about 100,000 ohm-cm, the relation of the carbon black loading and room temperature resistivity satisfying the equation $$2\,L + 5\log_{10} R \leqq 45$$

wherein L is the percentage by weight of the carbon black in the extruded composition. After extrusion in conventional fashion, we have learned, resistivity can be greatly reduced by subjection of the yet uncross-linked article to thermal structuring according to a time-temperature regime far more severe than that which heretofore has been employed for strain relief or improved electrode wetability, e.g., exposure to 300° F. for periods on the order of 24 hours. The resulting articles are suitable for freeze protection and other self-limiting applications, exhibit high Rp/Ri, and are otherwise advantaged by low black content. In particular and unlike extrudates with high black content, their resistivity-temperature properties are stable in storage and unaffected by temperature cycling.

DETAILED DESCRIPTION OF THE INVENTION

Figure 1:
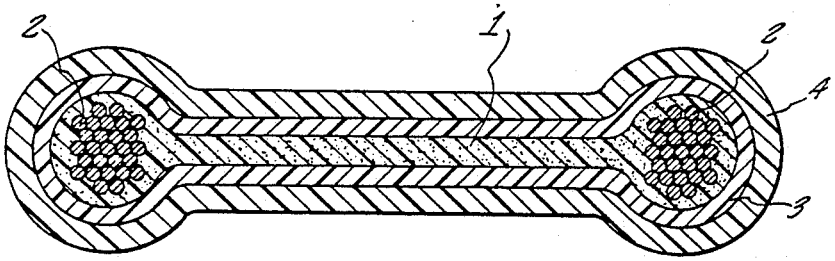
Figure 2:
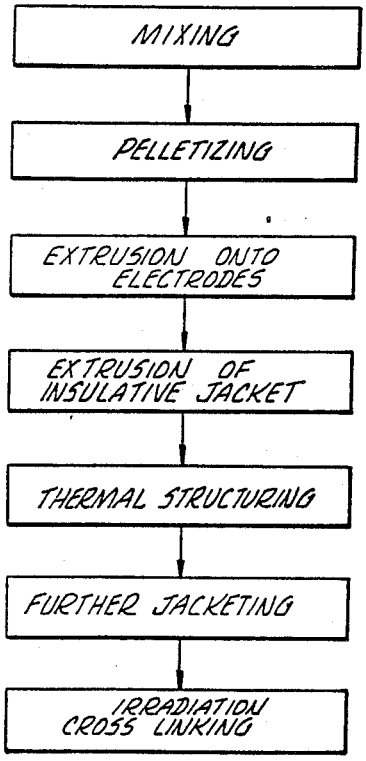

In order to obtain self-limiting compositions, the polymeric matrix in which conductive black is dispersed in whatever proportion must exhibit overall an appropriately non-linear coefficient of thermal expansion, for which reason a degree of crystallinity is believed essential. Generally, polymers exhibiting at least about 20% crystallinity as determined by x-ray diffraction are suited to the practice of the invention. Among the many polymers with which the invention may be practiced are polyolefins such as low, medium and high density polyethylenes and polypropylene, polybutene-1, poly(-dodecamethylene pyromellitimide), ethylene-propylene copolymers and terpolymers with non-conjugated dienes, polyvinylidine fluoride, polyvinylidine fluoride-tetrafluoroethylene copolymers, etc. As will be recognized by those skilled in the art, limiting temperatures tailored to the application intended (e.g., freeze protection, thermostatting, etc.,) may be obtained by appropriate selection of polymeric matrix material. For example, elements which self-limit at temperatures on the order of 100° F., 130° F., 150° F., 180° F. and 250° F. may be produced with, respectively, wax-poly(ethylene-vinyl acetate) blends, low density polyethylene, high density polyethylene, polypropylene and polyvinylidene fluoride. Other criteria of polymer selection will, in particular instances, include desired elongation, environmental resistance, ease of extrudibility, etc. as is well known.

Particularly preferred materials are multicomponent blends in which black is mixed with a first blend component to form a master batch which is in turn mixed with the principal polymeric component. The first and second polymer blend components are chosen such that they exhibit a positive free energy of mixing, one with the other. Their attendant incompatibility apparently has the effect of segregating contained black into generally delimited regions of the polymer matrix, and such blends have been proven extremely stable in the face of temperature cycling in use. In the case of single component matrices, cycling has occasionally had the effect of requiring that successively higher temperatures be attained to provide identical wattage values. Of course, even in the case of single component matrices, the low black loadings achieved according to this invention can result in satisfactory stability to cycling. Typically, the minor polymeric blend component is chosen for superior compatibility with carbon black relative to the blend component present in major proportion, while the latter component is selected for the particular physical properties desired in the overall extrudate. The principal blend component is preferably present in at least about 3:1 weight ratio relative to the minor component with which the black is first mixed. Presently, the blends most preferred have a polyethylene as the principal component, the other being an ethylene-vinyl ester copolymer, such as ethylene-vinyl acetate or ethylene-ethylacrylate copolymers. An especially preferred extrudate contains about 70:20 polyethylene: ethylene-ethyl acetate copolymer by weight.

The carbon blacks employed are those conventionally used in conductive plastics, e.g., high structure varieties such as furnace and channels blacks. Other conventional addends such as antioxidants, etc., may be employed provided only that their quantities and characteristics do not subvert the objects of the invention. An especially interesting class of beneficial addends, it has been found, are materials such as waxes which, while compatible with the predominant blend component, melt at lower temperature. The result is to permit obtainment of a given wattage at lower temperature, owing to a first packing effect of the wax on the resistivity-temperature curve. Compounding is conventional and generally involves banburying, milling and pelletizing prior to pressure extrusion of the self-limiting element from the melt.

In the preferred embodiment, the black-containing matrix is extruded onto a spaced-apart pair of elongate electrodes to form an element rod-shaped or, most preferably, dumbell-shaped in cross-section, the extruded thermoplastic both encapsulating and interconnecting the electrodes.

Now, in the freeze protection application in which self-limiting elements are most commonly employed it is desirable that at least about 4–8 watts per foot by available for transfer to ambient. With commonly available voltages ranging from 120 to 480 volts, resistivity values must be in the range from about 6,000 to 100,000 ohm-cm in order to generate 4 watts per foot and, of course, lower at a particular voltage to obtain as much as 8 watts/foot. However, we have found that following extrusion of compound containing not more than about 15% by weight carbon, room temperature resistivity is greater than about $10^7$ ohm-cm, and most commonly on the order of the resistivity of the dielectric polymer matrix itself. At such resistivities available wattage under power is essentially zero. We have learned that enormous increases in conductivity of each extrudates may be obtained by subjecting the extrudate to temperatures above the melt for periods substantially longer than those which heretofore have been employed to improve electrode wetting, etc., when self-limiting articles were achieved by other methods. By so doing, we having attained resistivities ranging from 5 to about 100,000 ohm-cm with carbon contents not greater than about 15% and indeed have commonly achieved room temperature resistivities well below 10,000 ohm-cm even at black loadings less than about 10%. The thermal structuring process apparently involves microscopic movement of carbon particles of a sort not commonly associated with "annealing", although that term is employed herein for the sake of convenience.

Annealing is performed at a temperature greater than about 250° F., preferably at at least about 300° F., and in any case at or above the melting point or range of the polymeric matrix in which the carbon black is dispersed. The period over which annealing is effected will, it will be appreciated, vary with the nature of the particular matrix and the amount of carbon black contained therein. In any case, annealing occurs over a time sufficient to reduce resistivity of the annealed element to satisfaction of the equation $2\,L+5\log_{10}R \leqq 45$, preferably $\leqq 40$, and the time necessary in a particular case may be readily determined empirically. Typically, annealing is conducted over a period in excess of 15 hours, and commonly at least about a 24 hour anneal is had. Where the element is held at anneal temperature continuously throughout the requisite period, it is advisable to control cooling upon completion of the anneal so that at least about one and one-half hours are required to regain room temperature. However, it has been learned that control of cooling is substantially less important where the requisite overall annealing residence time is divided into at least about 3 roughly equal stages, and the element returned to room temperature between each annealing stage.

Because the polymeric matrix of the black-containing extrudate is in the melt during annealing, that extrudate is preferably supplied prior to annealing, with an insulative extruded jacket of a thermoplastic material which is shape-retaining when brought to the annealing temperature. Jacketing materials suitable for the preferred embodiments of this invention are set out in the Examples which follow, and are discussed at length in the commonly assigned application entitled SELF-LIMITING CONDUCTIVE EXTRUDATES AND METHODS THEREFOR Ser. No. 287,442 filed Sept. 8, 1972 (now abandoned in favor of a continuation-in-part application, Ser. No. 434,277 filed Jan. 17, 1974, now U.S. Pat. No. 3,914,363 filed concurrently herewith, the disclosure of which is incorporated herein by reference.

Upon completion of annealing and optional addition of a further insulative jacket of, e.g., polyethylene, the self-limiting element is desirably subjected to ionizing radiation sufficient in strength to cross-link the black-containing core. Radiation dosage is selected with an eye to achieving cross-linking sufficient to impart a degree of thermal stability requisite to the particularly intended application without unduly diminishing crystallinity of the polymer matrix, e.g., overall crystallinity of the cross-linked black-containing matrix less than about 20% is to be avoided. Within those guidelines, radiation dosage may in particular cases range from about 2 to 15 megarads or more, and preferably is about 12 magarads.

The invention is further described in the following Examples of preferred embodiments thereof, in which all parts and percentages are by weight, and all resistivities measured at room temperature and with a Wheatstone bridge unless otherwise indicated.

EXAMPLE 1

Seventy-six lbs. of polyethylene (density 0.929 gm/cc, 32 lbs. of a mixture of 34% Vulcan XC-72 and ethylene ethyl acrylate copolymer (density 0.930 gm/cc, 18% ethyl acrylate) were loaded with 1 lb. of antioxidant into a Banbury mixer. The ram was closed and mixing commenced. When temperature reached about 240°-50° F. the batch was dumped, placed in a 2-roll mill, and cut off in strips which were fed to a pelletizing extruder. The pelletized compound was next extruded onto two parallel tinned copper electrodes (20 AWG 19/32) to form an extrudate generally dumbbell-shaped in cross-section. The electrodes were 0.275 inch apart (center-to-center), the interconnecting web being about 15 mils in thickness, at least 8 mils thickness of the semiconductive composition surrounding the electrodes. Extrusion was performed in a plasticating extruder with crosshead attachment (Davis-Standard 2"extruder, 24/1 L/D, with PE screw. Thereafter, the same extruder was arranged to extrude an 8 mil thick insulation jacket of polyurethane (Toxin 591-A, available from the Mobay Corporation). For optional geometric conformation, a conventional tube extrusion method was employed in which a vacuum (e.g. 5–20 in, $H_2O$) is drawn in the molten tube to collapse it about the semi-conductive core within about 3 inches of the extrusion head. The jacketed product was next spooled onto aluminum disks (26"dia) and exposed to 300° F. for 24 hours in a circulating air oven. Following this thermal structuring procedure and cooling to room temperature oven about 1½ hours the resistivity of the sample was determined at various temperatures. The following data was taken,

TABLE I

| Resistivity Variance with Temperature | |
|---|---|
| T, °F. | R, ohm-cm |
| 60 | 4,800 |
| 80 | 5,910 |
| 100 | 9,600 |
| 120 | 20,950 |
| 140 | 69,900 |
| 160 | 481,500 |
| 180 | 6,150,000 |
| 200 | $>2 \times 10^7$ |

EXAMPLES 2–9

Additional extrudates were prepared with various polymers and black loadings following the procedure of Example 1 save where otherwise indicated below. The polymeric matrices for the various examples were as follows: (2) a 3:1 blend of low density polyethylene: ethylene ethyl acrylate copolymer; (3) a 5:1 blend of low density polyethylene: ethylene vinyl acetate copolymer; (4) polyvinylidene fluoride; (5) a 3:1 blend of medium density polyethylene: ethylene-ethyl acrylate copolymer (6) a 3:1 blend of high density polyethylene: ethylene-ethyl acrylate copolymer; (7) ethylene/propylene copolymer (Eastman Chemical Company's "Polyallomer"); (8) polybitene-1; and (9) polyvinylidene fluoride/tetrafluoroethylene copolymer (Pennwalt Chemical Company's "Kynar 5200"). In the case of each blend, carbon black was first mixed with the minor component of the polymeric blend, and the resulting masterbatch mixed with the outer polymeric component. The jacketed extrudate of each composition exhibited a non-linear positive resistivity temperature coefficient. The data reported in Table II was taken.

TABLE II

| Example | % Carbon | R (as extruded) ohm-cm | R (annealed) ohm-cm | Rp ohm-cm | Annealing Regimen | 2 L + 5 log R |
|---|---|---|---|---|---|---|
| 2 | 10 | $10^9$ | $5 \times 10^3$ | $>10^7$ @ 210° F. | 24 hrs. 300° F. | 38.5 |
| 3 | 10 | $10^9$ | 6050 | $2 \times 10^5$ @ 212° F. | 18 hrs. 350° F. | 38.9 |
| 4 | 13 | $10^{12}$ | 116 | $6 \times 10^3$ @ 325° F. | 2 hrs. 450° F. | 36.5 |
| 5 | 13 | $10^{11}$ | 393 | $2.82 \times 10^6$ @ 240° F. | 15 hrs. 300° F. | 39.0 |
| 6 | 5 | $10^{11}$ | 570 | $2.66 \times 10^6$ @ 280° F. | 20 hrs. 300° F. | 23.0 |
| 7 | 9 | $10^{12}$ | 5980 | $5.78 \times 10^6$ @ 220° F. | 20 hrs. 400° F. | 36.9 |
| 8 | 13 | $10^{10}$ | 434 | $1.59 \times 10^5$ @ 210° F. | 5 hrs. 300° F. | 39.2 |
| 9 | 13 | $10^{11}$ | 39.9 | 800 @ 250° F. | 4 hrs. 450° F. | 34.0 |

EXAMPLE 10

The procedure of Example 1 was repeated to obtain an identical polyurethane-jacketed extrudate. Thereafter, the extrudate was exposed to 300° F. for 9 3-hour periods separated by intervals in which the article was permitted to cool to room temperature. Thereafter, the annealed article was provided with a final insulative jacket of polyethylene (12 mols in thickness) by the tubing extrusion method and cross-linked throughout by exposure to a 1-Nev electron beam for a total dose of 12 megarads. The strip so produced exhibited the following resistivity values at the temperatures given in Table III.

TABLE III

| T °F. | R ohm-cm | T °F. | R ohm-cm |
|---|---|---|---|
| 60 | 4800 | 140 | 69,900 |
| 80 | 5910 | 160 | 481,500 |
| 100 | 9600 | 180 | 6,150,000 |
| 120 | 20,950 | 200 | $>2 \times 10^7$ |

We claim:

1. An elongate self-regulating heater which comprises (1) a melt-extruded element composed of a conductive polymer composition which comprises conductive carbon black dispersed in a crystalline polymeric material, said crystalline polymeric material consisting essentially of (a) a mixture of polyethylene and a copolymer of ethylene and a vinyl ester, the mixture containing at least 50% by weight of the polyethylene;

(b) a mixture of polyethylene and a copolymer of ethylene and ethylacrylate, the mixture containing at least 50% by weight of the polyethylene; or (c) one or more of polyethylene, polypropylene, poly(dodecamethylene pyromellitimide), ethylene-propylene copolymers, terpolymers of ethylene, propylene and one or more non-conjugated dienes, polyvinylidene fluoride, and copolymers of vinylidene fluoride and tetra fluoroethylene; and (2) a pair of elongate parallel electrodes which are disposed in spaced-apart relation along and embedded in said element and are jointed by a web of said composition, and which can be connected to a source of electrical power to cause current to pass through the element, the percentage by weight(L) of conductive carbon black in said composition, based on the total weight thereof, being not greater than about 15, and the room temperature resistivity (R) in ohm-cm of said conductive polymer being such that $$2\,L+5\log_{10}R \leqq 45.$$

2. A heater according to claim 1 wherein $2\,L+5\log_{10}R \leqq 40$.

3. A heater according to claim 1, the polymeric material of said composition having been cross-linked.

4. A heater according to claim 1 wherein L is less than about 10.

5. A heater according to claim 1 wherein the polymeric material consists essentially of a mixture of polyethylene and a copolymer of ethylene and a vinyl ester, the mixture containing at least 50% by weight of the polyethylene.

6. A method of preparing a self-regulating heater which comprises the steps of (1) melt-extruding over a pair of elongate parallel electrodes held in spaced-apart relation an electrode-interconnecting web of a conductive polymer composition which comprises (a) a thermoplastic polymeric material exhibiting overall at least about 20% crystallinity as determined by x-ray diffraction and (b) conductive carbon black dispersed in said polymeric material, thereby forming an elongate element composed of said composition with the electrodes encapsulated therein and electrically connected to each other by a web of said composition, the percentage by weight (L) of carbon black based on the total weight of said composition being not more than about 10, and (2) heating the extruded element at or above the melting range of the polymeric material for a time sufficient to substantially reduce the resistivity of the composition.

7. A method of preparing an self-regulating heater which comprises the steps of (1) melt-extruding over a pair of elongate parallel electrodes held in spaced-apart relation an electrode-interconnecting web of a conductive polymer composition which comprises )a) a thermoplastic polymeric material exhibiting overall at least about 20% crystallinity as determined by x-ray diffraction and (b) conductive carbon black dispersed in said polymeric material, thereby forming an elongate element composed of said composition with the electrodes encapsulated thereon and electrically connected to each other by a web of said composition, the percentage by weight (L) of carbon black based on the total weight of said composition being not greater than about 15, and the polymeric material consisting essentially of (a) a mixture of polyethylene and a copolymer of ethylene and a vinyl ester, the mixture containing at least 50% by weight of the polyethylene;

(b) a mixture of polyethylene and a copolymer of ethylene and ethylacrylate, the mixture containing at least 50% by weight of the polyethylene; or (c) one or more of polyethylene, polypropylene, poly(dodecamethylene pyromellitimide), ethylene-propylene copolymers, terpolymers of ethylene, propylene and one or more non-conjugated dienes, polyvinylidene fluoride, and copolymers of vinylidene fluoride and tetrafluoroethylene; and (2) heating the extruded element at or above the melting range of the polymeric material for a time sufficient to substantially reduce the resistivity of the composition.

8. A method according to claim 7 wherein annealing is performed at a temperature of at least about 300° F. for a period of time sufficient to reduce R to satisfaction of the equation $$2\,L+5\log_{10}R \leqq 40.$$

9. A method according to claim 7 wherein L is not more than about 10 and annealing is performed at a temperature of at least about 300° F. over a period of not less than about 15 hours.

10. A method according to claim 7 wherein the polymeric material consists essentially of a mixture of polyethylene and a copolymer of ethylene and a vinyl ester, the mixture containing less than 50% by weight of the polyethylene.

11. A heater according to claim 1 wherein the polymeric material consists essentially of polyethylene or a mixture of polyethylene and a copolymer of ethylene and ethylacrylate.

12. A heater according to claim 1 wherein the polymeric material consists essentially of polyvinylidene fluoride.

13. A heater according to claim 1 wherein the polymeric material consists essentially of polypropylene or a mixture of polyethylene and polypropylene.

14. An elongate self-regulating heater which comprises (1) a melt-extruded element composed of a conductive polymer composition which comprises conductive carbon black dispersed in a crystalline polymeric material, and (2) a pair of elongate parallel electrodes which are disposed in spaced-apart relation along and embedded in said element and are joined by a web of said composition, and which can be connected to a source of electrical power to cause current to pass through the element, the percentage by weight (L) of conductive carbon black in said composition based on the total weight thereof being less than about 10, and the room temperature resistivity (R) in ohm-cm of said conductive polymer being such that $$2\,L+5\,\log_{10} R \leqq 45.$$

15. A heater according to claim 14 wherein the polymeric material consists of essentially of a mixture of polyethylene and a copolymer of ethylene and a vinyl ester, the mixture containing at least 50% by weight of the polyethylene.

16. A heater according to claim 14 wherein the polymeric material consists essentially of polyethylene or a mixture of polyethylene and a copolymer of ethylene and ethylacylate.

17. A heater according to claim 14 wherein the polymeric material consists essentially of polyvinylidene fluoride.

18. A heater according to claim 14 wherein the polymeric material consists essentially of polypropylene or a mixture of polyethylene and polypropylene.

* * * * *

UNITED STATES PATENT AND TRADEMARK OFFICE

CERTIFICATE OF CORRECTION

PATENT NO. : 4,954,695

DATED : September 4, 1990

INVENTOR(S) : Robert Smith-Johannsen; Jack M. Walker

It is certified that error appears in the above-identified patent and that said Letters Patent is hereby corrected as shown below:

| | |
|---|---|
| Column 1, line 14 | Replace "above-mentioned" by --above-identified-- |
| Column 1, line 55 | Replace "positive" by --resistive-- |
| Column 2, line 17 | Replace "inter alia" by --<u>inter</u> <u>alia</u>-- |
| Column 3, line 33 | After "preferred" insert --matrix-- |
| Column 4, line 33 | Replace "each" by --such-- |
| Column 6, line 2 | Replace "Toxin" by --Texin-- |
| Column 7, line 2 | Replace "mols" by --mils-- |
| Column 7, line 4 | Replace "Nev" by --Mev-- |
| Column 7, line 20 (Claim 1, line 4) | After "comprises" insert --a-- |
| Column 7, line 26 (Claim 1, line 10) | After "polyethylene;" insert --or-- |
| Column 7, line 28 (Claim 1, line 12) | Replace "ethylacrylate" by --ethyl acrylate-- |
| Column 7, line 41 (Claim 1, line 25) | After "," make the remainder of Claim 1 a separate paragraph, not indented, which commences with the words "the percentage..." |
| Column 7, line 42 (Claim 1, line 26) | Before "conductive" insert --the-- |

UNITED STATES PATENT AND TRADEMARK OFFICE

CERTIFICATE OF CORRECTION

PATENT NO. : 4,954,695

DATED : September 4, 1990

INVENTOR(S) : Robert Smith-Johannsen; Jack M. Walker

It is certified that error appears in the above-identified patent and that said Letters Patent is hereby corrected as shown below:

| | |
|---|---|
| Column 8, line 61. (Claims 6-10) | |
| Column 8, line 62 (Claim 11, line 1) | Replace "11" by --6-- |
| Column 8, lines 63-65 (Claim 11, lines 3-4) | Delete "or a mixture of polyethylene and a copolymer of ethylene and ethyl acrylate" |
| Column 8, line 66 (Claim 12, line 1) | Replace "12" by --7-- |
| Column 9, line 1 (Claim 13, line 1) | Replace "13" by --8-- |

Column 9, after line 3 (after Claim 13) Insert

--9. A heater according to Claim 1 wherein the polymeric material consists essentially of a mixture of polyethylene and a copolymer of ethylene and ethyl acrylate.

10. A heater according to Claim 9 wherein the conductive polymer has been prepared by mixing together (a) a blend of the conductive carbon black and the copolymer, and (b) the polyethylene, the ratio by weight of the polyethylene to the copolymer in the resulting mixture being at least 3:1.--

UNITED STATES PATENT AND TRADEMARK OFFICE

CERTIFICATE OF CORRECTION

PATENT NO. : 4,954,695

DATED : September 4, 1990

INVENTOR(S) : Robert Smith-Johannsen; Jack M. Walker

It is certified that error appears in the above-identified patent and that said Letters Patent is hereby corrected as shown below:

| | |
|---|---|
| Column 9, line 4 (Claim 14, line 1) | Replace "14" by --11-- |
| Column 9, line 8 (Claim 14, line 4) | After "comprises" insert --a-- |
| Column 9, line 17 (Claim 14, line 12) | After "the element,", make the remainder of the claim a separate paragraph, not indented, which starts with the words "the percentage..." |
| Column 9, line 18 (Claim 14, line 12) | Before "conductive" insert --the-- and after "composition" insert --,-- |
| Column 9, line 19 (Claim 14, line 13) | After "thereof" insert --,-- |
| Column 10, line 6 (Claim 15, line 1) | Replace "15" by --12-- and replace "14" by --11-- |
| Column 10, line 11 (Claim 16, line 1) | Replace "16" by --13-- and replace "14" by --11-- |
| Column 10, line 15 (Claim 17, line 1) | Replace "17" by --14-- and replace "14" by --11-- |
| Column 10, line 18 (Claim 18, line 1) | Replace "18" by --15-- and replace "14" by --11-- |
| Column 10, after line 20 (after Claim 18) | Insert |

-- 16. A heater according to Claim 11 wherein the polymeric material consists essentially of a mixture of polyethylene and a copolymer of ethylene and ethyl acrylate.

UNITED STATES PATENT AND TRADEMARK OFFICE
CERTIFICATE OF CORRECTION

PATENT NO. : 4,954,695

DATED : September 4, 1990

INVENTOR(S) : Robert Smith-Johannsen; Jack M. Walker

It is certified that error appears in the above-identified patent and that said Letters Patent is hereby corrected as shown below:

17. A heater according to Claim 16 wherein the conductive polmer has been prepared by mixing together (a) a blend of the conductive carbon black and the copolymer, and
(b) the polyethylene, the ratio by weight of the polyethylene to the copolymer in the resulting mixture being at least 3:1.--

Signed and Sealed this

Ninth Day of April, 1991

*Attest:*

*Attesting Officer*

HARRY F. MANBECK, JR.

*Commissioner of Patents and Trademarks*